US011473871B1

(12) United States Patent
Cai

(10) Patent No.: US 11,473,871 B1
(45) Date of Patent: Oct. 18, 2022

(54) LIQUID REPLENISHING MECHANISM AND WATER GUN

(71) Applicant: Teng Cai, Shantou (CN)

(72) Inventor: Teng Cai, Shantou (CN)

( * ) Notice: Subject to any disclaimer, the term of this patent is extended or adjusted under 35 U.S.C. 154(b) by 0 days.

(21) Appl. No.: 17/848,865

(22) Filed: Jun. 24, 2022

(30) Foreign Application Priority Data

May 23, 2022 (CN) ..... 202221246405.X

(51) Int. Cl.
*F41B 9/00* (2006.01)

(52) U.S. Cl.
CPC ..... *F41B 9/0031* (2013.01); *F41B 9/0062* (2013.01)

(58) Field of Classification Search
CPC .... F41B 9/0006; F41B 9/0009; F41B 9/0031; F41B 9/0062
See application file for complete search history.

(56) References Cited

U.S. PATENT DOCUMENTS 3,971,292 A * 7/1976 Paniagua ..... B05B 5/025 361/232
4,135,559 A * 1/1979 Barnby ..... A63H 23/10 273/365
5,225,623 A * 7/1993 Krasnow ..... F41H 13/0037 89/1.1

FOREIGN PATENT DOCUMENTS

WO WO-2021214063 A1 * 10/2021 ..... F41B 9/0006

* cited by examiner

*Primary Examiner* — Donnell A Long

(74) *Attorney, Agent, or Firm* — Daniel M. Cohn; Howard M. Cohn

(57) ABSTRACT

A liquid replenishing mechanism and a water gun include a housing, a conductive component, a conveying component, and a liquid storage component. The housing includes a first outer surface. The conductive component is exposed outside the first outer surface and is electrically connected with the conveying component. The conveying component defines a liquid inlet end extended to the first outer surface and communicated with an outside of the housing and a liquid outlet end. The liquid storage component includes a liquid storage cavity communicated with the liquid outlet end. The conductive component is driven by the first outer surface to contact with liquid or moved away from the liquid. The conveying component is electrically connected with a power supply through the liquid. The liquid is input through the liquid inlet end and is output to the liquid storage cavity through the liquid outlet end.

10 Claims, 5 Drawing Sheets

LIQUID REPLENISHING MECHANISM AND WATER GUN

TECHNICAL FIELD

The present disclosure relates to a technical field of toys, and in particular to a liquid replenishing mechanism and a water gun.

BACKGROUND

A toy water gun generally stores liquid in a container, and imparts kinetic energy to the liquid by means of pressure, etc., so that the liquid is shot out along a predetermined trajectory. The toy water gun is widely liked by users.

However, in a process of using a conventional toy water gun, there are still following defects.

Firstly, some toy water guns need to open a plug of a liquid storage container for manual water replenishment. A water replenishing process is cumbersome and the liquid storage container is hardly filled, which makes a low space utilization rate of the water storage container.

Secondly, there are also some toy water guns that replenish water to the liquid storage container through an automatic water absorption mechanism. However, it still need to manually close a switch to control the automatic water absorption mechanism, and a control process is cumbersome.

SUMMARY

The present disclosure provides a liquid replenishing mechanism and a water gun to solve technical problems that a space utilization rate of a water storage container is low and a water replenishment control process is complicated.

Technical schemes adopted by the present disclosure to solve the technical problems are as follow.

The present disclosure provides a liquid replenishing mechanism. The liquid replenishing mechanism comprises a housing, a conductive component, a conveying component, and a liquid storage component.

The housing comprises a first outer surface. The conductive component is exposed outside the first outer surface. The conveying component defines a liquid inlet end and a liquid outlet end. The liquid storage component comprises a liquid storage cavity.

The conductive component is electrically connected with the conveying component. The liquid inlet end extends to the first outer surface and is communicated with an outside of the housing. The liquid outlet end is communicated with the liquid storage cavity.

The conductive component is driven by the first outer surface to contact with liquid, so that the conveying component is electrically connected with a power supply through the conductive component and the liquid. The liquid is input through the liquid inlet end and is output to the liquid storage cavity through the liquid outlet end.

The conductive component is driven by the first outer surface to move away from the liquid, so the conveying component is disconnected from the power supply to stop conveying of the liquid.

In some embodiments, two through holes are on the first outer surface. The conductive component comprises two conductive pieces. The two conductive pieces are not contacted with each other.

Each of the conductive pieces correspondingly passes through a respective through hole of the two through holes.

One end of each of the conductive pieces is exposed outside the first outer surface. A first conductive piece of the two conductive pieces is electrically connected with the power supply. A second conductive piece of the two conductive pieces is electrically connected with the conveying component.

The first conductive piece is electrically connected with the second conductive piece through the liquid when the two conductive pieces contact the liquid, so the power supply is electrically connected with the conveying component.

In some embodiments, a liquid guiding hole is on the first outer surface.

The liquid storage component further comprises a water inlet pipe communicated with the liquid inlet end and a water outlet pipe communicated with the liquid outlet end. The water inlet pipe is communicated with the liquid guiding hole. The water outlet pipe is communicated with the liquid storage cavity.

In some embodiments, the liquid storage component comprises a tank.

The liquid storage cavity is arranged in the tank. An upper end of the tank defines a guiding hole. The liquid is conveyed into the liquid storage cavity from the guiding hole. A lower end of the tank defines a discharging hole. The liquid in the liquid storage cavity is discharged from the discharging hole. The guiding hole is communicated with the liquid outlet end.

The present disclosure further provides a water gun. The water gun comprises the liquid replenishing mechanism mentioned above and a shooting mechanism arranged in the housing. The shooting mechanism is configured to receive the liquid discharged from the liquid storage cavity and is configured to shoot the liquid out of the housing along a predetermined trajectory.

In some embodiments, the water gun further comprises a triggering mechanism.

The triggering mechanism comprises a trigger movably arranged on the housing, a first conductive contact plate arranged in the housing, and a second conductive contact plate arranged on the trigger.

The trigger drives the second conductive contact plate to contact the first conductive contact plate, so the second conductive contact plate is electrically connected with the first conductive contact plate and the conveying component is electrically connected with the power supply. When the conveying component is electrically connected with the power supply, the shooting mechanism is electrically connected with the power supply and a pressure of the liquid in the liquid storage cavity is increased, so the liquid is conveyed to the shooting mechanism.

In some embodiments, the shooting mechanism comprises a drive component arranged in the housing, a transmission component drivably connected with the drive component, a shooting channel communicated with the outside of the housing, and a pushing component slidably arranged in the shooting channel.

The shooting channel is configured to receive the liquid discharged from the liquid storage cavity. The transmission component drives the pushing component to move along the predetermined trajectory in the shooting channel under driving of the drive component, so the liquid in the shooting channel is pushed by the pushing component to shoot out along the shooting channel.

In some embodiments, the transmission component comprises an elastic piece arranged in the housing, a sleeve abutting against the elastic piece, a rack arranged on the sleeve, a transmission gear component connected with the drive component, and an intermittent gear arranged on the transmission gear component.

The drive component drives the transmission gear component to rotate and the transmission gear component drives the intermittent gear to rotate. When the intermittent gear rotates to engage with the rack, the intermittent gear drives the sleeve to move against elastic force of the elastic piece through the rack.

When the intermittent gear is separated from the rack, the sleeve is driven by the elastic piece to abut against the pushing component, and the pushing component is driven by the sleeve to move, so the liquid is shot out.

In some embodiments, the pushing component comprises a pushing rod slidably arranged in the shooting channel and a sealing ring arranged on one end of the pushing rod.

The sealing ring abuts against an inner wall of the shooting channel. The pushing rod is pushed to move in a direction opposite to a shooting direction by the liquid in the shooting channel.

In some embodiments, the water gun further comprises a flexible buttstock arranged on the housing.

The liquid replenishing mechanism and the water gun of the present disclosure relate to the technical field of toys. In the liquid replenishing mechanism, when the conductive component contacts the liquid, the conductive component arranged on the first outer surface is conductive, so that the conveying component is electrically connected to the power supply to work. The conveying component sucks the liquid through the liquid inlet end on the first outer surface, and convey the liquid into the liquid storage cavity. In this way, compared with a liquid replenishment method that relies on self-leveling of the liquid, transmission pressure generated by the conveying component ensures quick and full replenishment of the liquid, so the liquid storage cavity has a high space utilization rate. At the same time, the present disclosure eliminates tediousness of manually controlling a switch to control the conveying component, and improves convenience of water replenishment in the liquid storage cavity.

BRIEF DESCRIPTION OF DRAWINGS

The present disclosure will be further described below in conjunction with the accompanying drawings and embodiments. In the drawings.

DETAILED DESCRIPTION

In order to have a clearer understanding of technical features, purposes and effects of the present disclosure, the specific embodiments of the present disclosure will now be described in detail with reference to the accompanying drawings.

Figure 1:
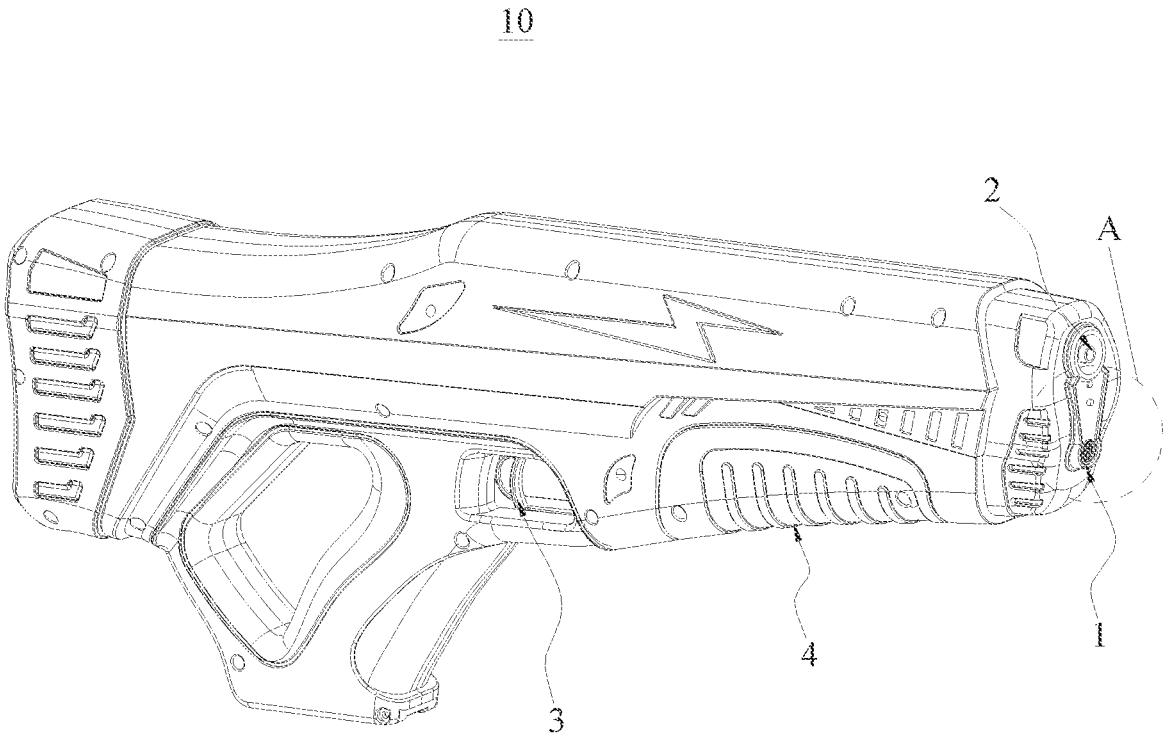
FIG. 1 is a schematic diagram of a water gun according to one embodiment of the present disclosure.

FIG. 1 shows a water gun 10 according to some embodiments of the present disclosure. The water gun 10 is configured to receive liquid and shoot the liquid out along a predetermined trajectory. The water gun 10 comprises a liquid replenishing mechanism 1 and a power supply 5. The liquid replenishing mechanism 1 is configured to replenish liquid so as to make the liquid to be shot out.

As shown in FIGS. 1-6, the liquid replenishing mechanism 1 comprises a housing 11, a conductive component 12, a conveying component 13, and a liquid storage component 14. The housing 11 comprises a first outer surface 111. The conductive component 12 is exposed outside the first outer surface 111. The conveying component 13 defines a liquid inlet end 131 and a liquid outlet end 132. The liquid storage component 14 comprises a liquid storage cavity 1431.

The conductive component 12 is electrically connected with the conveying component 13. The liquid inlet end 131 extends to the first outer surface 111 and is communicated with an outside of the housing 1. The liquid outlet end 132 is communicated with the liquid storage cavity 1431.

The conductive component 12 is driven by the first outer surface 111 to contact with the liquid, so that the conveying component 13 is electrically connected with the power supply 5 through the conductive component 12 and the liquid. The liquid is input through the liquid inlet end 131 and is output to the liquid storage cavity 1431 through the liquid outlet end 132. The conductive component 12 is driven by the first outer surface 111 to move away from the liquid, so the conveying component 13 is disconnected from the power supply 5 to stop conveying of the liquid.

It is understood that the housing 11 is configured to install and accommodate other components, and plays a protective role to a certain extent. The housing 11 is also configured to be held by a user. The conductive component 12 is configured to connected or disconnect the power supply 5 and the conveying component 13. The conveying component 13 is configured to transmit the liquid along a certain direction. The liquid storage component 14 is configured to storage the liquid conveyed by the conveying component 13. The first outer surface 111 is configured to position the conductive component 12 and a liquid inlet portion of the liquid inlet end 131, so the water inlet portion of the liquid inlet end 131 contacts a liquid surface when the conductive component 12 is electrically connected through the liquid. Therefore, long-term evacuation of the conveying component 13 is avoided when replenishing water. The power supply 5 is configured to provide electrical energy to the conveying component 13 through the conductive component 12 and the liquid in contact with the conductive component 12, so as to drive the conveying component 13 to work and convey the liquid.

It is also understood that the first outer surface 111 is defined on an outer surface of the water gun 10. Optionally, the first outer surface 111 is a surface of a front end of a gun head, so that the user automatically replenishes the water simply by contacting the gun head with the liquid, which makes a water replenishment operation convenient. The conductive component 12 may include two conductive pieces that does not contact with each other and are both exposed outside the first outer surface 111. The two conductive pieces are electrically connected with each other through the liquid when the two conductive pieces are in contact with the liquid at the same time. Of course, in other embodiments, the conductive component 12 may include a plurality of conductive pieces. When two predetermined conductive pieces of the plurality of conductive pieces contact the liquid at the same time, the two predetermined conductive pieces are electrically connected by using the liquid as a medium.

It should be noted that, if the liquid replenishing mechanism needs to replenish the liquid, the user can hold the housing 11 to contact the first outer surface 111 with a liquid surface or insert the first outer surface into the liquid, so that the conductive components 12 arranged on the first outer surface 111 contacts the liquid. Therefore, the power supply 5 transfers the electrical energy to the conveying component 13 by using the conductive component 12 and the liquid contacted with the conductive component 12 as a medium. The conveying component 13 is powered on to suck the liquid flow from outside of the first outer surface 111 to the liquid inlet end 131 and then transmit it to the liquid storage cavity 1431 through the liquid outlet end 132 to perform water replenishment operation.

After the liquid is replenished, the first outer surface 111 is pulled out from the liquid surface to release contact between the conductive component 12 and the liquid. Lacking the liquid as a conductive medium, the power supply 5 is not electrically connected with the conveying component 13 and the water replenishment is stopped.

In summary, the liquid transmitted through the conveying component 13 has a certain pressure. Compared with a method that relies on the self-leveling of the liquid in the prior art, the liquid with the certain pressure is able to quickly and fully fill the liquid storage cavity 1431, thereby improving the efficiency of the water replenishment and improving a space utilization rate of the liquid storage cavity 1431. Moreover, a process of the water replenishment is convenient and fast. Further, because setting of an electrical switch is omitted, manufacturing cost of the water gun is also reduced.

Optionally, the power supply 5 comprises a battery arranged in the housing 11, and the battery may be detachable or non-detachable, which is not limited thereto.

Figure 2:
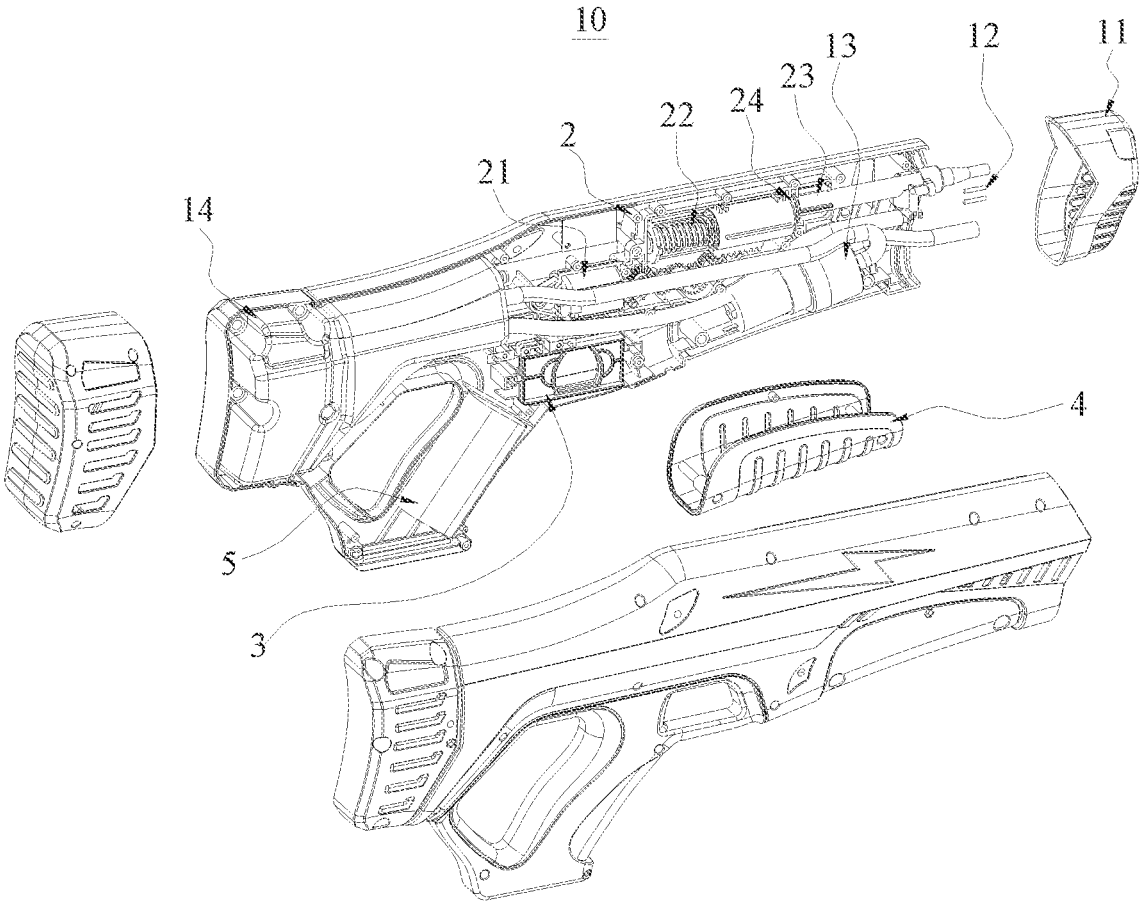
FIG. 2 is an exploded schematic diagram of the water gun shown in FIG. 1.
Figure 3:
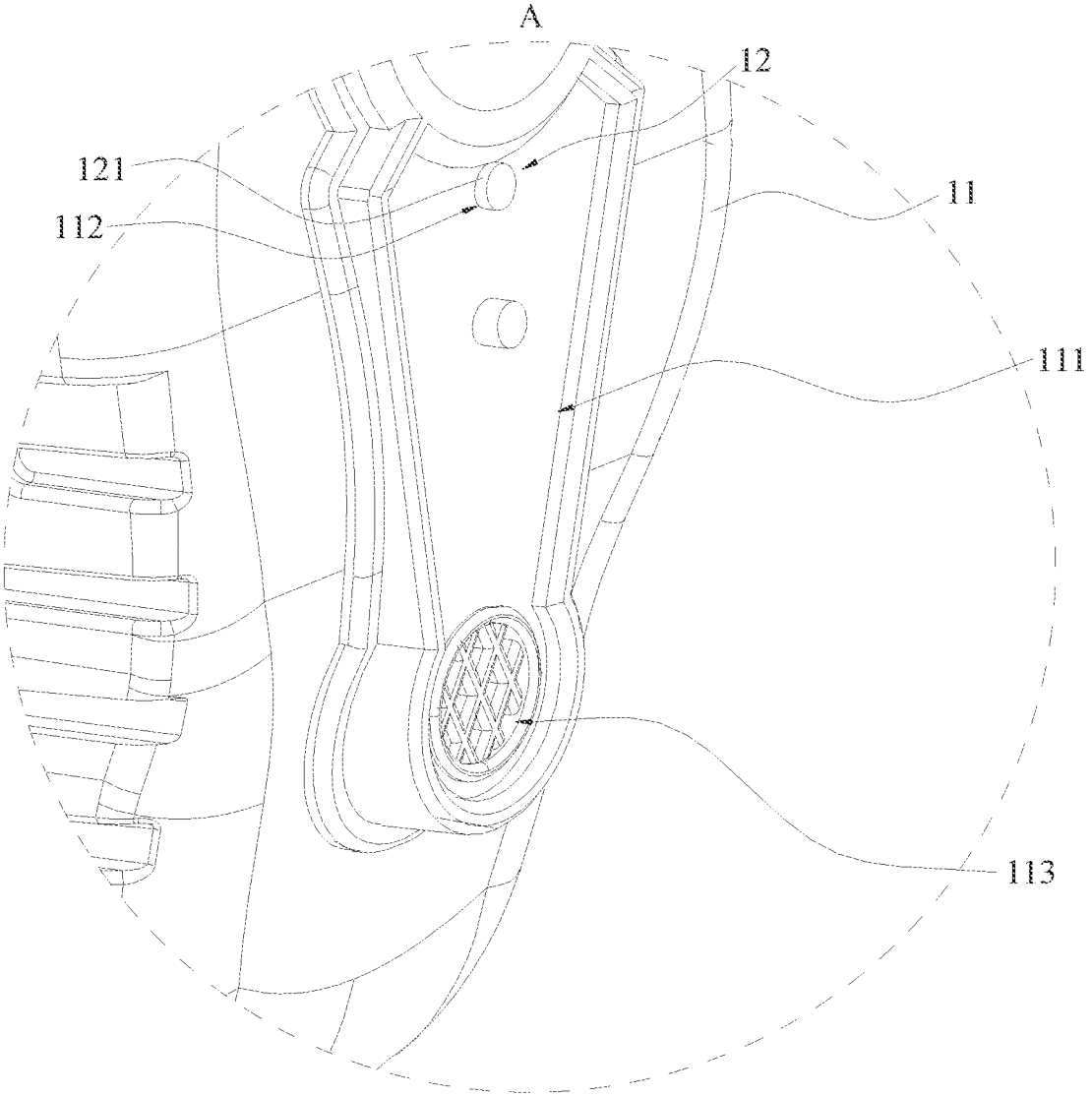
FIG. 3 is an enlarged schematic diagram of portion A of the water gun shown in FIG. 1.
Figure 4:
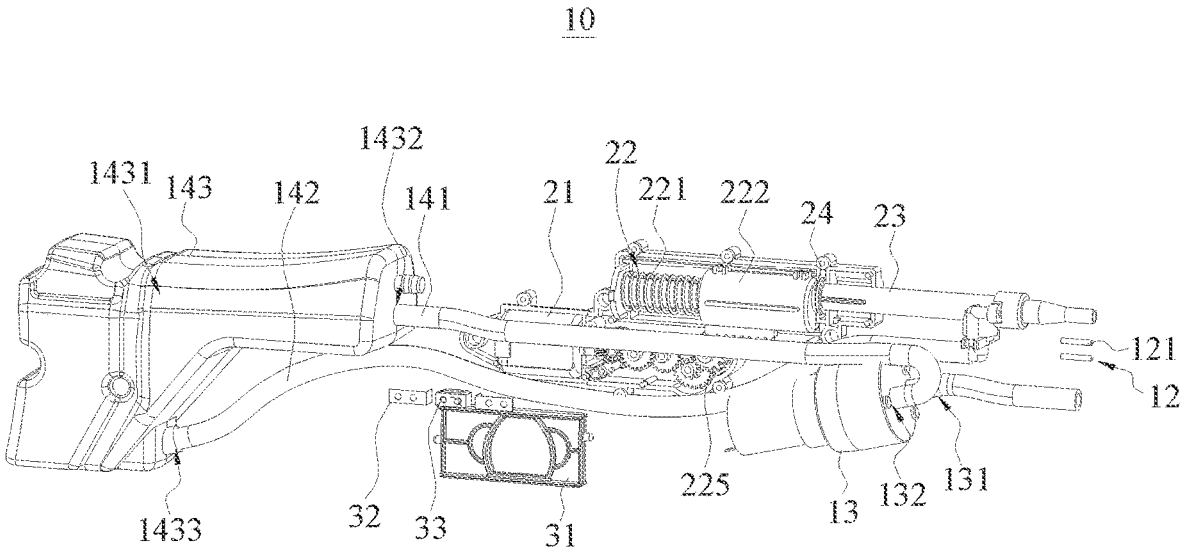
FIG. 4 is a schematic diagram of some components of the water gun shown in FIG. 2.

As shown in FIGS. 2-4, in some embodiments of the water replenishing mechanism, two through holes 112 are on the first outer surface 111. The conductive component 12 comprises two conductive pieces 121. The two conductive pieces are not contacted with each other.

Each of the conductive pieces 121 correspondingly passes through a respective through hole 1112 of the two through holes 112. One end of each of the conductive pieces 121 is exposed outside the first outer surface 111. A first conductive piece 121 of the two conductive pieces 121 is electrically connected with the power supply 5. A second conductive piece 121 of the two conductive pieces 121 is electrically connected with the conveying component 13.

The first conductive piece 121 is electrically connected with the second conductive piece 121 through the liquid when the two conductive pieces 121 contact the liquid, so the power supply 5 is electrically connected with the conveying component 13.

It can be understood that the through holes 112 is configured to install the conductive pieces 121, so a first end of each of the conductive pieces 121 is exposed outside the first outer surface 111 and s second end of each of the conductive pieces 121 is arranged in the housing 11 to electrically connect with the power supply 5 and the conveying component 13. The two conductive pieces 121 play a conductive role, and the two conductive pieces 121 are electrically connected with each other with the liquid as the conductive medium when they are in contact with the liquid at the same time. Therefore, the electrical energy of the power supply 5 is transmitted to the conveying component 13, and the conveying component 13 is driven to replenish the liquid.

It should be noted that when one element is electrically connected with another element, the two elements may be directly connected or the two elements may be indirectly connected through a circuit board or an electrical control element. Further, a size of an interval between the two conductive pieces 121 is set flexibly only if the two conductive pieces 121 are able to conduct electricity by simultaneously contacting the liquid. Of course, the interval between the two conductive pieces 121 should not be too close, so long-term connection due to formation of adhesive liquid between the two conductive pieces 121 is avoided and the conveying component 13 is prevented from being overheated and damaged due to long-term evacuation.

As shown in FIGS. 2-4, in some embodiments of the liquid replenishing mechanism, a liquid guiding hole 113 is on the first outer surface 111. The liquid storage component 14 further comprises a water inlet pipe 141 communicated with the liquid inlet end 131 and a water outlet pipe 142 communicated with the liquid outlet end 132. The water inlet pipe 141 is communicated with the liquid guiding hole 113. The water outlet pipe 142 is communicated with the liquid storage cavity 1431.

It is understood that a filter net is arranged on the liquid guiding hole 113 to prevent impurities from flowing into the liquid guiding hole, so damage to the conveying component 13 is avoided. Both of the water inlet pipe 141 and the water outlet pipe 142 play a role of guiding flow of the liquid. Optionally, the water inlet pipe 141 and the water outlet pipe 142 are hoses, and the hoses are bendable to a certain extent to adapt to space and contour of an interior of the liquid replenishing mechanism.

It is also understood that the water inlet pipe 141 may also pass through the liquid guiding hole 113 and may be exposed outside the first outer surface 111. In this embodiment, the filter net is arranged on a port of the water inlet pipe 141.

As shown in FIGS. 3-4, in some embodiments of the liquid replenishing mechanism 1, the liquid storage component 14 comprises a tank 143. The liquid storage cavity 1431 is arranged in the tank 143. An upper end of the tank 143 defines a guiding hole 1432. The liquid is conveyed into the liquid storage cavity 1431 from the guiding hole 1432. A lower end of the tank 143 defines an discharging hole 1433. The liquid in the liquid storage cavity 1431 is discharged from the discharging hole 1433. The guiding hole 1432 is communicated with the liquid outlet end 132.

It is understood that the tank 143 is configured to contain the liquid. The guiding hole 1432 is configured to transmit the liquid discharged from the liquid outlet end 132 of the conveying component 13. The discharging hole 1433 is configured to guide the liquid to a predetermined shooting position for shooting of the liquid.

Optionally, the tank 143 is arranged at a rear end of the water gun 10. On the one hand, a space at the rear end of the water gun 10 is relatively sufficient, and on the other hand, the tank 143 and the conveying component 13 need to be arranged as far as possible to avoid short-circuit and burning of the conveying component 13 when the liquid leaks from the tank 143. Furthermore, by arranging the tank 143 at the rear end of the water gun 10, a weight of the conveying component 13 arranged on a front end of the water gun 10 and other mechanisms is balanced with the tank 143, so that an overall center of gravity of the water gun tends to be consistent with a center of the water gun 10. Therefore, the water gun is convenient to hold.

It should be noted that injecting liquid from a top portion of the tank 143 further improves the space utilization rate of the liquid storage cavity 1431, and discharging the liquid from a bottom portion of the tank 143 improves a utilization rate of the liquid inside the liquid storage cavity 1431 to avoid liquid residue.

As shown in FIGS. 1 and 2, in some embodiments of the water gun 10, the water gun 10 comprises a shooting mechanism 2 arranged in the housing 11. The shooting mechanism 2 is configured to receive the liquid discharged from the liquid storage cavity 1431 and is configured to shoot the liquid out of the housing 11 along a predetermined trajectory.

It is understood that when the shooting mechanism 2 needs to be powered on, the shooting mechanism 2 may be electrically connected to the power supply 5. Of course, a power supply element may also be provided separately to supply power to the shooting mechanism 2.

As shown in FIGS. 1 and 2, in some embodiments of the water gun 10, the water gun 10 further comprises a triggering mechanism 3 arranged at the housing 11. The triggering mechanism 3 is configured to connect the power supply 5 with the conveying component 13 when the user holds the water gun 10 to perform a shooting operation, so that the conveying component 13 works to pressurize the liquid storage cavity 1431.

It is understood that, by pressurizing the liquid storage cavity 1431 by the conveying component 13, the liquid is provided with the force to flow to the shooting position against its gravity, so as to ensure that the liquid in the liquid storage cavity 1431 is fully utilized.

It should be noted that, for one embodiment in which the liquid is directly discharged from the bottom portion of the liquid storage cavity 1431 without pressurizing and is guided to a predetermined shooting position, since it is necessary to overcome the gravity of the liquid to transmit the liquid, a water pump is further added to pump the liquid at the bottom portion of the liquid storage cavity 1431 to a high level, the manufacturing cost is increased and an volume of the water gun is increased and the compactness thereof is decreased. On the contrary, in the present disclosure, by arrangement of the conveying component 13, not only the liquid is driven to flow from a low level to a high level, but there is no need to add drive elements such as a water pump, which reduces the manufacturing cost and improves the compactness of the water gun.

As shown in FIG. 4, in some embodiments, the triggering mechanism 3 comprises a trigger 31 movably arranged on the housing 11, a first conductive contact plate 32 arranged in the housing 11, and a second conductive contact plate 33 arranged on the trigger 31.

The trigger 31 drives the second conductive contact plate 33 to contact the first conductive contact plate 32, so the second conductive contact plate 33 is electrically connected with the first conductive contact plate 32 and the conveying component 13 is electrically connected with the power supply 5. When the conveying component 13 is electrically connected with the power supply 5, the shooting mechanism 2 is electrically connected with the power supply 5 and a pressure of the liquid in the liquid storage cavity is increased, so the liquid is conveyed to the shooting mechanism 2.

It is understood that the trigger 31 is rotatably arranged on the housing 11 through a rotating shaft, or the trigger 31 is slidably arranged on the housing 11 through a sliding rail. Furthermore, a spring connected with the trigger 31 is arranged in the housing 11. When the user releases the trigger 31, the trigger 31 is driven to reset by the spring.

Both of the first conductive contact plate 32 and the second conductive contact plates 33 are metal conductive plates, and the surface-to-surface contact between the metal conductive plates ensures reliability of electrical energy conduction and avoid poor contact. The first conductive contact plate 32 and the second conductive contact plates 33 may be indirectly connected to the power supply 5 and the conveying component 13 through a circuit board or the like.

It should be noted that when the first conductive contact plate 32 and the second conductive contact piece 33 are in contact, the power supply 5 not only drives the conveying component 13 to work, but also drives the shooting mechanism 2 to work to shoot the liquid.

As shown in FIGS. 2-6, in some embodiments, the shooting mechanism 2 comprises a drive component 21 arranged in the housing 11, a transmission component 22 drivably connected with the drive component 21, a shooting channel 23 communicated with the outside of the housing 11, and a pushing component 24 slidably arranged in the shooting channel 23.

The shooting channel 23 is configured to receive the liquid discharged from the liquid storage cavity 1431. The transmission component 22 drives the pushing component 24 to move along the predetermined trajectory in the shooting channel 23 under driving of the drive component 21, so the liquid in the shooting channel 23 is pushed by the pushing component 24 to shoot out along the shooting channel 23.

It should be understood that the drive component 21 is configured to provide torque to the transmission component 22. The transmission component 22 is configured to drive the pushing component 24 to reciprocate linearly along the shooting channel 23. The shooting channel 23 is configured to accommodate liquid. A one-way valve may be arranged in the shooting channel 23 adjacent to a position where the liquid is shot out to ensure the pressure of the shooting channel 23 and the pressure of the pipes and the cavity communicated with the shooting channel 23. The pushing component 24 is configured to jack the liquid in the shooting channel 23 to flow and shoot out along the shooting channel 23.

It is also understood that the drive component 21 is a motor. The transmission component 22 is, but is not limited to, a transmission structure such as a gear group, a screw rod, and the like. According to a moving direction of the pushing component 24, components such as springs that is able to generate force may be added. The shooting channel 23 is cylindrical. A cross-section of the pushing component 24 is matched with a cross-section of the shooting channel 23 to ensure tightness of the water gun, so the liquid is prevented from leaking from a gap between the shooting channel 23 and the pushing component 24, and the conveying component 13 and the drive component 21 are prevented from short circuit due to the liquid.

Figure 5:
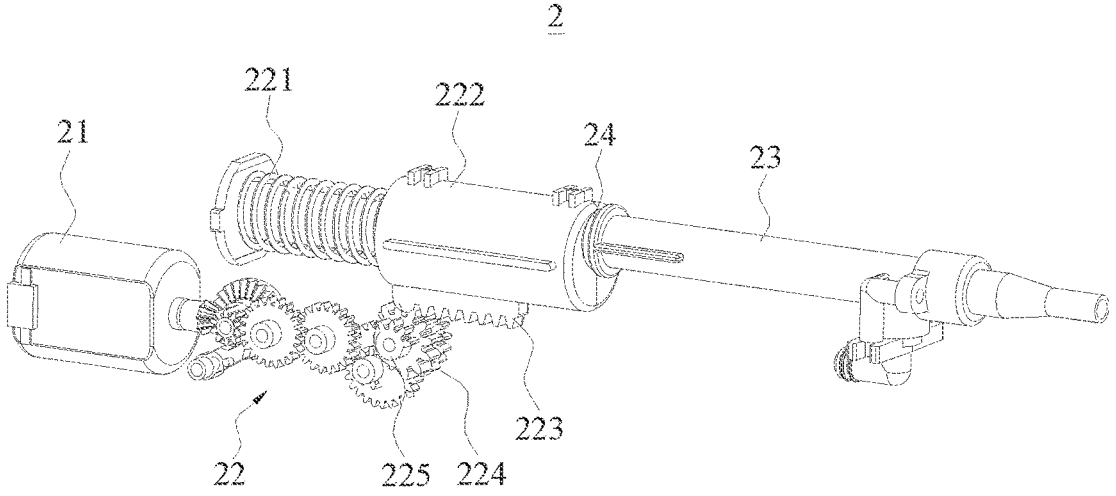
FIG. 5 is a schematic diagram of a shooting mechanism of the water gun shown in FIG. 4.
Figure 6:
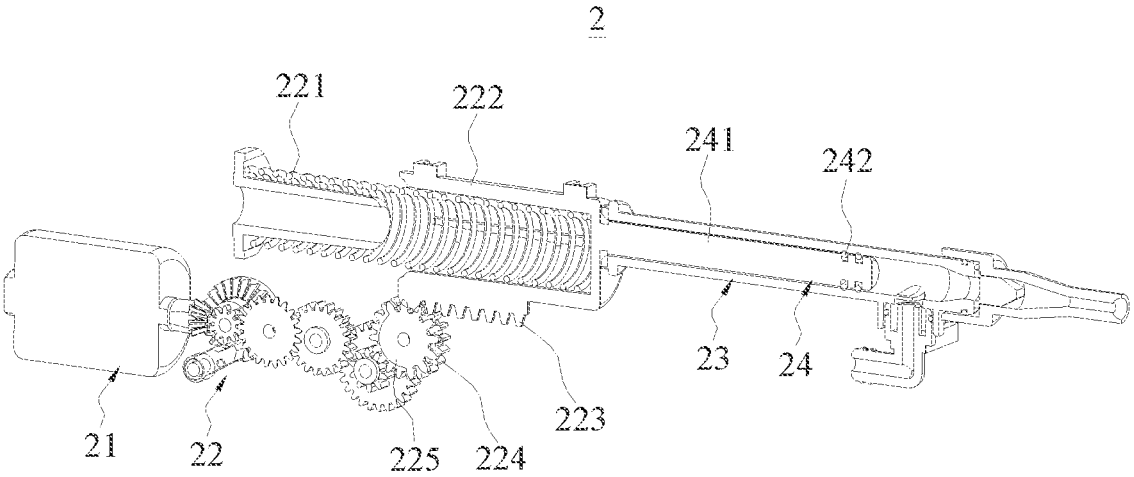
FIG. 6 is a schematic diagram showing an interior of the shooting mechanism shown in FIG. 5.

As shown in FIGS. 4-6, in some embodiments, the transmission component 22 comprises an elastic piece 221 arranged in the housing 11, a sleeve 222 abutting against the elastic piece 221, a rack 223 arranged on the sleeve 222, a transmission gear component 224 connected with the drive component 21, and an intermittent gear 225 arranged on the transmission gear component 224.

The drive component 21 drives the transmission gear component 224 to rotate and the transmission gear component 224 drives the intermittent gear 225 to rotate. When the intermittent gear 225 rotates to engage with the rack, the intermittent gear 225 drives the sleeve 222 to move against elastic force of the elastic piece. When the intermittent gear 225 is rotated to separate from the rack 223, the sleeve 222 is driven by the elastic piece 221 to abut against the pushing component 24, and the pushing component 24 is driven by the sleeve 222 to move, so the liquid is shot out.

It is understood that the elastic piece 221 may be a spring. The sleeve 222 is sleeved on the elastic piece 221 and is connected with the elastic piece 221 to prevent the elastic piece 221 from being biased or twisted. The rack 223 is configured to slide in a direction opposite to the shooting direction when the rack 223 is driven by the intermittent gear 225. The transmission gear component 224 is configured to be driven by the drive component 21 and is configured to drive the intermittent gear 225 to rotate synchronously. The intermittent gear 225 and the transmission gear component 224 rotate coaxially. That is, a relative angle between the intermittent gear 225 and the transmission gear component 224 does not change.

It is also be understood that the drive component 21 may be directly connected with the transmission gear component 224 or the drive component 21 may be indirectly connected with the transmission gear component 224 through several gears, so that an installation position of the drive component 21 is more flexible and the drive component 21 is adapted to different transmission ratio requirements. Teeth are only arranged on a part of an edge of the intermittent gear 225. The teeth of the intermittent gear 225 are configured to engage with the rack 223.

It should be noted that the drive component 21 outputs torque to the transmission gear component 224. The transmission gear component 224 drives the intermittent gear 225 to rotate in a predetermined direction. At this time, when the intermittent gear 225 is not in contact with the rack 223 and there is no transmission relationship between the intermittent gear 225 and the rack 223, the sleeve 222 is at a rightmost position close to a right end of the pushing component under the elastic force of the elastic piece 221. Then the intermittent gear 225 further rotates to engage with the rack 223, and the intermittent gear 225 drives the sleeve 222 to overcome the elastic force of the elastic piece 221 to slide toward a leftmost position through the rack 223. During this process, a compression amount of the elastic piece 221 is continuously increased.

Subsequently, since the teeth of the intermittent gear 225 are only arranged at a part of the edge of the intermittent gear 225, the intermittent gear 225 further rotates, to separate from the rack 223, and the intermittent gear 225 is no longer engaged with the rack 223. At this time, the elastic piece 221 is released instantaneously, and the elastic piece 221 drives the sleeve 222 to push or impact the pushing component 24 to move toward the shooting direction, so as to achieve the purpose of shooting the liquid.

As shown in FIGS. 4-6, in some embodiments, the pushing component 24 comprises a pushing rod 241 slidably arranged in the shooting channel 23 and a sealing ring 242 arranged on one end of the pushing rod 241. The sealing ring 242 abuts against an inner wall of the shooting channel 23. The pushing rod 241 is pushed to move in a direction opposite to the shooting direction by the liquid in the shooting channel 23.

It is understood that the sealing ring 242 is configured to seal a gap between the pushing rod 241 and the shooting channel 23, which prevents the liquid in the shooting channel 23 from leaking into the housing 11 and helps to maintain a certain pressure in the shooting channel 23. The pushing rod 241 is configured to push the liquid to move along the shooting direction in the shooting channel 23. Therefore, the liquid is shot out of the housing 11.

As shown in FIGS. 1 and 2, in some embodiments, the water gun 10 further comprises a flexible buttstock 4 arranged on the housing 11.

It is understood that the flexible buttstock 4 makes the user comfortable when lifting the water gun 10, which improves the use comfort.

The liquid replenishing mechanism and the water gun of the present disclosure relate to the technical field of toys. In the liquid replenishing mechanism, when the conductive component contacts the liquid, the conductive component arranged on the first outer surface is conductive, so that the conveying component is electrically connected to the power supply to work. The conveying component sucks the liquid through the liquid inlet end on the first outer surface, and convey the liquid into the liquid storage cavity. In this way, compared with a liquid replenishment method that relies on self-leveling of the liquid, transmission pressure generated by the conveying component ensures quick and full replenishment of the liquid, so the liquid storage cavity has a high space utilization rate. At the same time, the present disclosure eliminates tediousness of manually controlling a switch to control the conveying component, and improves convenience of water replenishment in the liquid storage cavity.

The above embodiments are only for illustrating the technical concept and characteristics of the present disclosure and the purpose thereof is to enable those skilled in the art to understand the content of the present disclosure and implement accordingly. The above embodiments are not intended to limit the protection scope of the present disclosure. All equivalent changes and modifications made within the scope of the claims of the present disclosure shall belong to the scope of the claims of the present disclosure.

What is claimed is:

1. A liquid replenishing mechanism, comprising:

a housing;

a conductive component;

a conveying component; and a liquid storage component;

wherein the housing comprises a first outer surface; the conductive component is exposed outside the first outer surface; the conveying component defines a liquid inlet end and a liquid outlet end; the liquid storage component comprises a liquid storage cavity;

wherein the conductive component is electrically connected with the conveying component; the liquid inlet end extends to the first outer surface and is communicated with an outside of the housing; the liquid outlet end is communicated with the liquid storage cavity;

wherein the conductive component is driven by the first outer surface to contact with liquid, so that the conveying component is electrically connected with a power supply through the conductive component and the liquid; and the liquid is input through the liquid inlet end and is output to the liquid storage cavity through the liquid outlet end;

wherein the conductive component is driven by the first outer surface to move away from the liquid, so the conveying component is disconnected from the power supply to stop conveying of the liquid.

2. The liquid replenishing mechanism according to claim 1, wherein two through holes are on the first outer surface; the conductive component comprises two conductive pieces; the two conductive pieces are not contacted with each other;

wherein each of the conductive pieces correspondingly passes through a respective through hole of the two through holes; one end of each of the conductive pieces is exposed outside the first outer surface; a first conductive piece of the two conductive pieces is electrically connected with the power supply; and a second conductive piece of the two conductive pieces is electrically connected with the conveying component;

wherein the first conductive piece is electrically connected with the second conductive piece through the liquid when the two conductive pieces contact the liquid, so the power supply is electrically connected with the conveying component.

3. The liquid replenishing mechanism according to claim 1, wherein a liquid guiding hole is on the first outer surface;

wherein the liquid storage component further comprises a water inlet pipe communicated with the liquid inlet end and a water outlet pipe communicated with the liquid outlet end; the water inlet pipe is communicated with the liquid guiding hole; the water outlet pipe is communicated with the liquid storage cavity.

4. The liquid replenishing mechanism according to claim 1, wherein the liquid storage component comprises a tank;

wherein the liquid storage cavity is arranged in the tank; an upper end of the tank defines a guiding hole; the liquid is conveyed into the liquid storage cavity from the guiding hole; and a lower end of the tank defines an discharging hole; the liquid in the liquid storage cavity is discharged from the discharging hole; the guiding hole is communicated with the liquid outlet end.

5. A water gun, comprising the liquid replenishing mechanism according to claim 1 and a shooting mechanism arranged in the housing; the shooting mechanism is configured to receive the liquid discharged from the liquid storage cavity and is configured to shoot the liquid out of the housing along a predetermined trajectory.

6. The water gun according to claim 5, wherein the water gun further comprises a triggering mechanism;

wherein the triggering mechanism comprises a trigger movably arranged on the housing, a first conductive contact plate arranged in the housing, and a second conductive contact plate arranged on the trigger;

wherein the trigger drives the second conductive contact plate to contact the first conductive contact plate, so the second conductive contact plate is electrically connected with the first conductive contact plate and the conveying component is electrically connected with the power supply; when the conveying component is electrically connected with the power supply, the shooting mechanism is electrically connected with the power supply and a pressure of the liquid in the liquid storage cavity is increased, so the liquid in the liquid storage cavity is conveyed to the shooting mechanism.

7. The water gun according to claim 5, wherein the shooting mechanism comprises a drive component arranged in the housing, a transmission component connected with the drive component, a shooting channel communicated with the outside of the housing, and a pushing component slidably arranged in the shooting channel;

wherein the shooting channel is configured to receive the liquid discharged from the liquid storage cavity, the drive component drives the transmission component to move and the transmission component drives the pushing component to move along the predetermined trajectory in the shooting channel, so the liquid in the shooting channel is pushed by the pushing component to shoot out along the shooting channel.

8. The water gun according to claim 7, wherein the transmission component comprises an elastic piece arranged in the housing, a sleeve abutting against the elastic piece, a rack arranged on the sleeve, a transmission gear component connected with the drive component, and an intermittent gear arranged on the transmission gear component;

wherein the drive component drives the transmission gear component to rotate and the transmission gear component drives the intermittent gear to rotate; when the intermittent gear rotates to engage with the rack, the intermittent gear drives the sleeve to move against elastic force of the elastic piece;

wherein when the intermittent gear rotates to separate from the rack, the sleeve is driven by the elastic piece to abut against the pushing component, and the pushing component is driven by the sleeve to move, so the liquid is shot out.

9. The water gun according to claim 7, wherein the pushing component comprises a pushing rod slidably arranged in the shooting channel and a sealing ring arranged on one end of the pushing rod;

wherein the sealing ring abuts against an inner wall of the shooting channel; the pushing rod is pushed to move in a direction opposite to a shooting direction by the liquid in the shooting channel.

10. The water gun according to claim 7, wherein the water gun further comprises a flexible buttstock arranged on the housing.

* * * * *